US007806492B2

(12) United States Patent
Furukawa et al.

(10) Patent No.: US 7,806,492 B2
(45) Date of Patent: Oct. 5, 2010

(54) PRINTHEAD AND PRINTING APPARATUS

(75) Inventors: Tatsuo Furukawa, Zama (JP); Nobuyuki Hirayama, Fujisawa (JP); Yoshiyuki Imanaka, Kawasaki (JP); Teruo Ozaki, Yokohama (JP); Takuya Hatsui, Tokyo (JP); Takaaki Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 12/270,683

(22) Filed: Nov. 13, 2008

(65) Prior Publication Data

US 2009/0122097 A1 May 14, 2009

(30) Foreign Application Priority Data

Nov. 14, 2007 (JP) ..... 2007-296032

(51) Int. Cl.
*B41J 29/38* (2006.01)

(52) U.S. Cl. ..... 347/5; 347/9

(58) Field of Classification Search ..... 347/5, 347/9

See application file for complete search history.

(56) References Cited

U.S. PATENT DOCUMENTS

| | | | | |
|---|---|---|---|---|
| 5,519,417 | A * | 5/1996 | Stephany et al. | 347/14 |
| 6,290,334 | B1 | 9/2001 | Ishinaga et al. | |
| 2003/0142164 | A1 * | 7/2003 | Nishida | 347/19 |
| 2004/0125157 | A1 * | 7/2004 | Edelen et al. | 347/9 |
| 2005/0041049 | A1 * | 2/2005 | Masuda | 347/10 |
| 2005/0206685 | A1 | 9/2005 | Hirayama | |

* cited by examiner

*Primary Examiner*—Julian D Huffman
(74) *Attorney, Agent, or Firm*—Canon USA Inc IP Div

(57) ABSTRACT

A printhead in which the voltage fluctuation absorption range of a MOS transistor serving as a constant current source is narrowed according to constant current driving. The printhead includes a controller which controls voltage fluctuations to adjust a current supplied to a plurality of printing elements. The printhead also includes a DC/DC converter which outputs a voltage of a voltage value to be applied to a plurality of printing elements from outside a printing element substrate.

3 Claims, 13 Drawing Sheets

PRINTHEAD AND PRINTING APPARATUS

BACKGROUND OF THE INVENTION

1. Field of the Invention

The present invention relates to an inkjet printhead in which heating elements for discharging ink and driving circuits for driving them are formed on a single element substrate, and a printing apparatus using the inkjet printhead.

2. Description of the Related Art

As disclosed in the U.S. Pat. No. 6,290,334, heating elements and their driving circuits on a printhead mounted in a conventional inkjet printing apparatus are formed on a single element substrate using a semiconductor process. The U.S. Patent Publication No. 2005/0206685 discloses a technique of supplying power to heating elements by a so-called constant current driving method.

FIG. 5 is a circuit diagram for explaining the arrangement of a driving control circuit arranged on the element substrate of a printhead using a conventional constant current driving method.

In FIG. 5, heating elements 101*a*1 to 101*mx* are used to print. The respective heating elements are energized to generate heat, discharging ink droplets from corresponding nozzles. The heating elements 101*a*1 to 101*mx* are divided into groups a to m. Each group includes x heating elements, and x MOS transistors arranged in correspondence with the respective heating elements. MOS transistors 102*a*1 to 102*mx* turn on/off power supply to corresponding heating elements. Each of constant current sources 103*a* to 103*m* is arranged in a corresponding group. A printing data supply circuit 104 controls the ON/OFF state of each MOS transistor 102 in accordance with printing data. A reference current circuit (IREF) 105 outputs a control signal to the constant current sources 103*a* to 103*m* via a line 110 to control constant current values made constant by the respective constant current sources. Power supply terminals 106 and 107 are connected to a power supply unit (not shown) outside the element substrate. The element substrate receives, via these power supply terminals, power for driving heating elements. Power supply lines 108 and 109 supply, from the power supply terminals 106 to 107 to the groups a to m, power for driving heating elements.

In group a, the MOS transistors 102*a*1 to 102*ax* are respectively series-connected to the corresponding heating elements 101*a*1 to 101*ax*. Each MOS transistor controls on/off of a current supply to the series-connected heating element. More specifically, the drain terminals of the MOS transistors 102*a*1 to 102*ax* are connected to the corresponding heating elements 101*a*1 to 101*ax*. The source terminals of the MOS transistors 102*a*1 to 102*ax* are commonly connected to the constant current source 103*a*. One end of each of the heating elements 101*a*1 to 101*ax* is also commonly connected to the power supply line 108. The MOS transistors 102*a*1 to 102*ax* are the first driving switches of the heating elements 101*a*1 to 101*ax*. The constant current source 103*a* is the second driving switch of the heating elements 101*a*1 to 101*ax*. This arrangement also applies to the remaining groups b to m.

The constant current sources 103*a*, . . . , 103*m* are respectively series-connected to the MOS transistors 102*a*1 to 102*ax*, . . . , 102*m*1 to 102*mx* and the heating elements 101*a*1 to 101*ax*, . . . , 101*m*1 to 101*mx*. Each of the constant current sources 103*a* to 103*m* sets a current flowing through it to a predetermined constant current value. The constant current value is adjusted by inputting a control signal from the reference current circuit 105 via the line 110.

The printing data supply circuit 104 outputs, to the gate terminals of the MOS transistors 102*a*1 to 102*mx*, a printing data signal corresponding to an image to be printed. The printing data supply circuit 104 controls switching of the MOS transistors 102*a*1 to 102*mx*.

FIG. 6 is a circuit diagram showing an arrangement in which MOS transistors 111*a* to 111*m* replace the constant current sources 103*a* to 103*m* in FIG. 5.

The drain terminals of the MOS transistors 111*a* to 111*m* are respectively connected to the source terminals of the MOS transistors 102*a*1 to 102*mx*. The gate terminals of the MOS transistors 111*a* to 111*m* are connected to the line 110 to receive a control signal output from the reference current circuit 105.

This arrangement sets constant currents flowing through the NMOS transistors 111*a* to 111*m* to a predetermined constant current value. The constant current value is controlled by the gate voltages of the MOS transistors 111*a* to 111*m* connected to the reference current circuit 105.

For example, if the number of simultaneously driven heating elements increases, the wiring resistance in the element substrate may rise and fluctuation between wiring resistances becomes greater and greater, and the fluctuation ratio of voltages applied to respective heating elements may increase. However, this arrangement can make energy amounts applied to respective heating elements almost constant. A wiring line outside the element substrate is shared between a plurality of heating elements. Even if the voltage drop on a common wiring line changes depending on the number of simultaneously driven heating elements, energy amounts applied to respective heating elements can be made almost constant. Even if the voltage of an external power supply unit for supplying power to the printhead fluctuates, energy amounts applied to respective heating elements can be made almost constant.

In this way, the constant current driving method can make almost constant energy amounts applied to respective heating elements that vary due to various factors. This is because the reference current circuit 105 controls currents input to the gate terminals of the MOS transistors 111*a* to 111*m* serving as constant current sources. Voltage fluctuations upon variations of the ON resistances of the MOS transistors 111*a* to 111*m* can also be absorbed.

In addition to the above-described voltage fluctuations, when printheads different in the resistance value of the heating element are manufactured, power generated by the heating element may differ between the printheads. In this case, according to the constant current driving method of always supplying a constant current to heating elements, generated energy also differs between the printheads due to the difference in the resistance value of the heating element. To solve this, a D/A converter is arranged, as shown in FIG. 7, to externally input a signal and set the value of a current supplied from a constant current circuit. More specifically, in FIG. 7, current value setting data are serially input as digital signals to a D/A converter 701 via terminals 702 and 703. Based on the data, a voltage generated by the D/A converter 701 is supplied to the reference current circuit 105. This voltage is reflected in the gate voltages of the MOS transistors 111*a* to 111*m*, finally supplying a current of a desired value to respective heating elements. In this manner, the printhead performs constant current driving using an optimum set current based on the heating element resistance value acquired in advance.

Setting of a current value by the D/A converter is performed by circuits formed on a single element substrate, so the setting of the current value can be changed quickly. For this reason, even when energy applied to the heating element is to be changed during printing due to any factor, the setting of the current value can be changed. For example, when the printhead temperature changes during printing, the time of energization to the heating element is generally controlled to keep the ink discharge characteristic constant. Instead, the value of a current flowing through the heating element can be changed to keep the ink discharge characteristic constant.

However, to meet the demand for suppressing voltage fluctuations caused by a variety of factors and the demand for changing energy applied to the heating element, the range of voltage fluctuations absorbed by the MOS transistor serving as a constant current source becomes very large. Voltage fluctuations absorbed by the MOS transistor are voltage fluctuations occurred when the number of simultaneously driven heating elements increases for time-division driving or the like. More specifically, such voltage fluctuations are those absorbed by the MOS transistor to correct instantaneous fluctuations of the current/voltage upon simultaneous driving. To suppress voltage fluctuations, for example, the size of the MOS transistor needs to be increased. However, this leads to a large circuit size and high cost. A voltage absorbed by the MOS transistor is consumed as power by the ON resistance, wasting power. This leads to power loss, raises the printhead temperature, and negatively affects stable ink discharge.

If the voltage fluctuation range becomes wide, the current value setting range by the D/A converter also becomes wide. In a D/A converter with a resolution kept unchanged, the minimum fluctuation width becomes large, and the precision of the set current becomes low. To keep the minimum fluctuation width constant, the resolution needs to be increased, but the size of the D/A converter itself increases.

Further, if the range of voltage fluctuations absorbed by the MOS transistor becomes wide, a voltage applied between the power supply and GND rises in proportion to the range because a voltage applied to the heating element is always constant and the heating element and MOS transistor are series-connected to each other. If the voltage rises excessively, it exceeds the tolerable level of the MOS transistor. To increase the tolerable level of the MOS transistor, the transistor manufacturing process needs to be complicated. In addition, the transistor size increases, and the cost rises.

SUMMARY OF THE INVENTION

The present invention is directed to a printhead and a printing apparatus incorporating the same.

First of all, the present invention employs an arrangement using a MOS transistor as a constant current source in constant current driving. For example, a printhead according to this invention is capable of suppressing voltage fluctuations with relatively fast temporal variation upon simultaneous driving of heating elements, and also suppressing voltage fluctuations caused by a factor with relatively slow temporal variation, such as variations of the resistance value between heating elements. A printing apparatus according to this invention uses this printhead.

According to one aspect of the present invention, preferably, there is provided a printhead having a plurality of printing elements and a plurality of switching elements arranged in correspondence with the respective printing elements, the printhead comprising: a constant current source which supplies a constant current to the plurality of printing elements; a controller controlling the constant current source to adjust a current supplied to the plurality of printing elements; and a DC/DC converter which directly receives a DC voltage from outside, converts the DC voltage into a voltage value to be applied to the plurality of printing elements, and outputs a voltage of the voltage value to the plurality of printing elements, wherein the plurality of printing elements, the plurality of switching elements, the constant current source, and the controller are formed on a single element substrate, and the DC/DC converter is arranged on another element substrate different from the element substrate.

According to another aspect of the present invention, preferably, there is provided a printing apparatus which scans a head carriage to which a printhead is mounted, and performs printing on a printing medium by the printhead, wherein the printhead includes: a plurality of printing elements; a plurality of switching elements arranged in correspondence with the respective printing elements; a constant current source which supplies a constant current to the plurality of printing elements; and a controller controlling the constant current source to adjust a current supplied to the plurality of printing elements. The apparatus comprises: an output unit outputting a DC voltage to the head carriage; and a DC/DC converter which is arranged on the head carriage, receives a DC voltage output from the output unit, converts a value of the input DC voltage into a voltage value to be applied to the plurality of printing elements, and outputs a voltage of the voltage value to the plurality of printing elements.

According to still another aspect of the present invention, preferably, there is provided a printing apparatus having a printhead including: a plurality of printing elements; a plurality of switching elements arranged in correspondence with the respective printing elements; a constant current source which supplies a constant current to the plurality of printing elements; and a controller controlling the constant current source to adjust a current supplied to the plurality of printing elements. The apparatus comprises: a DC/DC converter which is arranged in a main body of the printing apparatus, converts a DC voltage input from a power supply unit into voltage values of a voltage to be applied to the plurality of printing elements, a voltage to be applied to the plurality of switching elements, and a voltage to be applied to a logic circuit of the printhead, and outputs voltages of the voltage values to the plurality of printing elements, the plurality of switching elements, and the logic circuit.

The invention is particularly advantageous since stable ink discharge can be achieved by suppressing voltage fluctuations with relatively fast temporal variation upon simultaneous driving of heating elements, and also suppressing voltage fluctuations caused by a factor with relatively slow temporal variation, such as variations of the resistance value between heating elements.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

First, an outline of an inkjet printhead to which the present invention is applicable will be described.

Figure 8B:
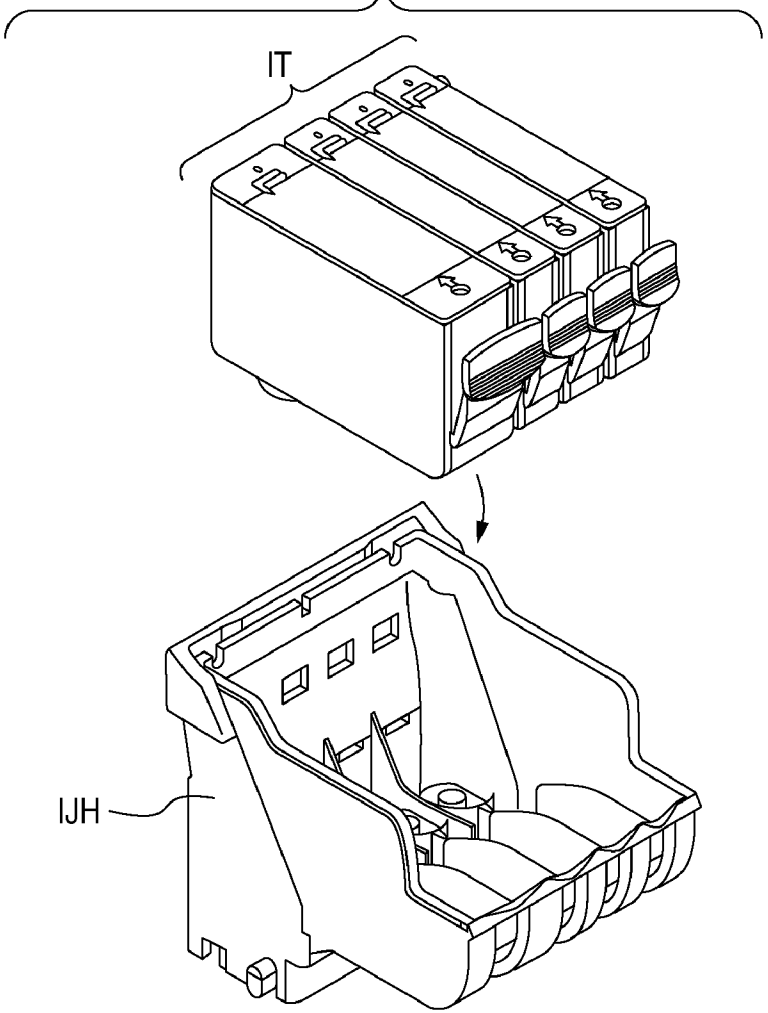
FIGS. 8A and 8B are perspective views of a general inkjet printhead.
Figure 8A:
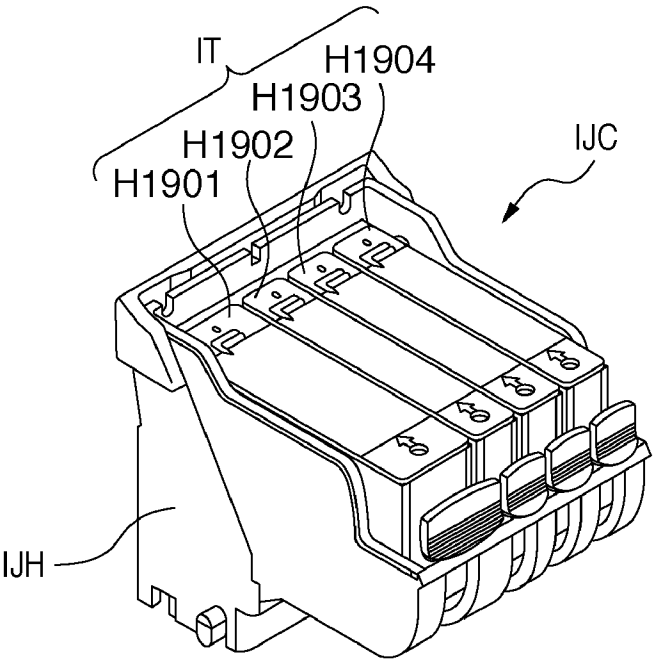

As is apparent from the perspective views of FIGS. 8A and 8B, an inkjet printhead IJH according to a typical embodiment is a building component of a printhead cartridge IJC. The printhead cartridge IJC is made up of the inkjet printhead IJH, and an ink tank IT which is detachably mounted in the inkjet printhead IJH and includes ink tanks H1901, H1902, H1903, and H1904. The printhead IJH discharges, from orifices, ink (printing liquid) supplied from the ink tank IT in accordance with printing information.

The printhead cartridge IJC is fixed and supported by the positioning means and electrical contact of a head carriage 200 mounted in the inkjet printing apparatus main body. The printhead cartridge IJC is detachable from the head cartridge 200.

Figure 9:
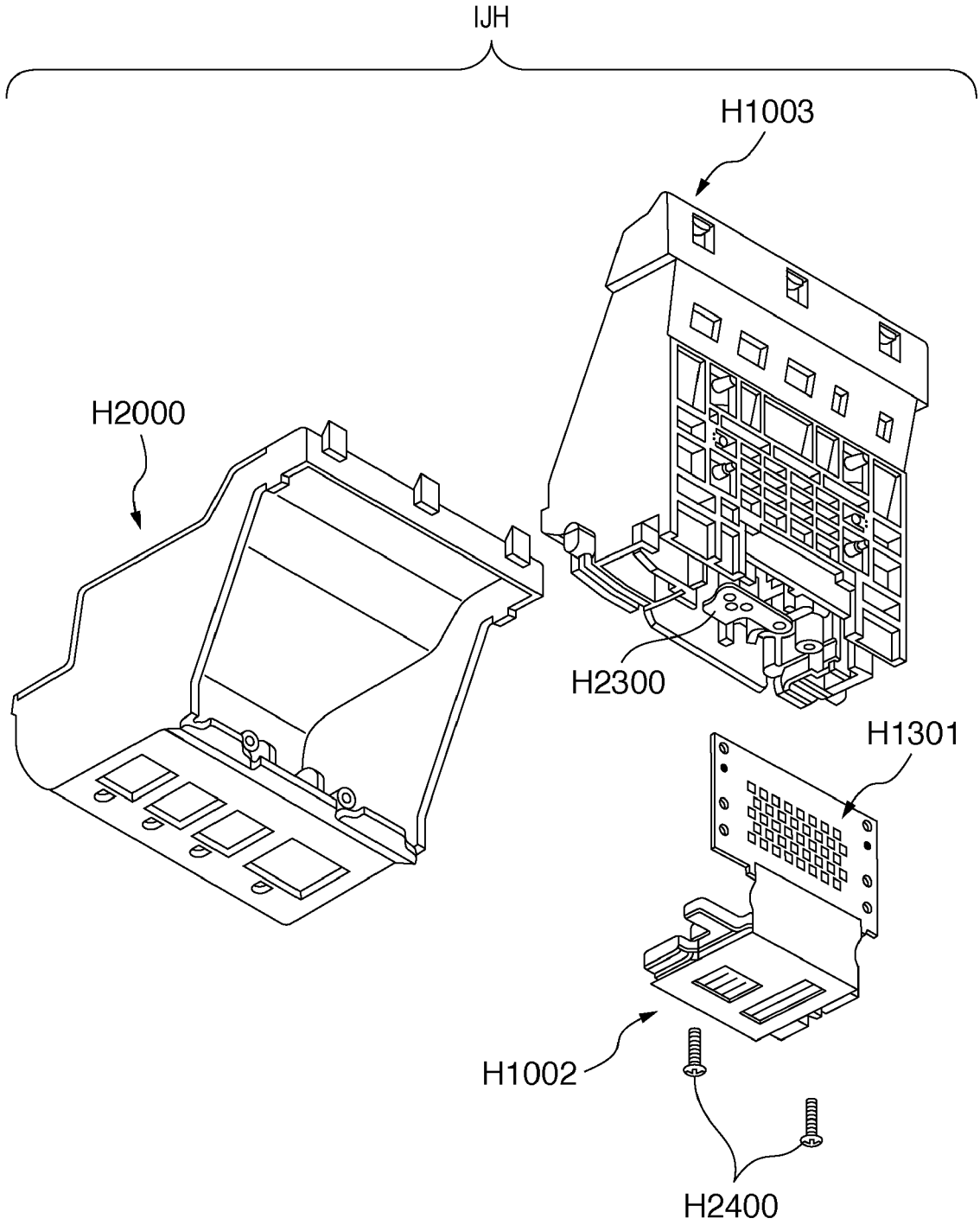
FIG. 9 is a perspective view of the general inkjet printhead.

As shown in the exploded perspective view of FIG. 9, the printhead IJH comprises a heating element unit H1002 having a plurality of heating elements as printing elements. Further, the printhead IJH comprises an ink supply unit (printing liquid supply means) H1003, and a tank holder H2000. In the printhead IJH, the ink communication ports of the heating element unit H1002 and ink supply unit H1003 need to communicate with each other without leaking ink. For this purpose, the heating element unit H1002 and ink supply unit H1003 are fixed in press contact with each other with screws H2400 via a joint sealing member H2300.

Figure 10:
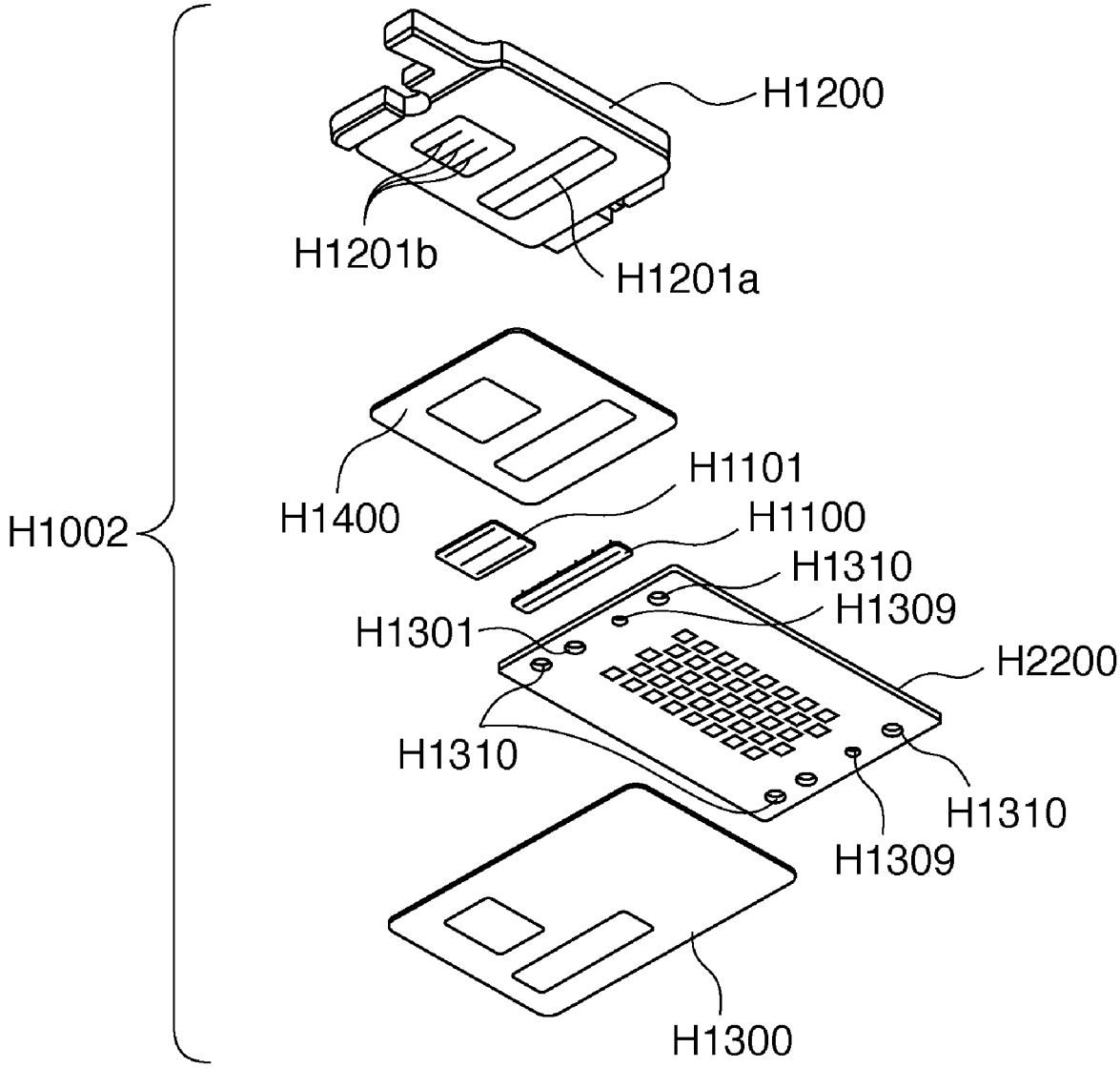
FIG. 10 is a perspective view of the general inkjet printhead.

Also, as shown in the exploded perspective view of FIG. 10, an element substrate H1100 and an element substrate H1101 are bonded and fixed to a first plate H1200. The first plate H1200 has color ink orifices H1201*b* corresponding to respective ink colors, and a black ink orifice H1201*a*. A second plate H1400 having openings is bonded and fixed to the first plate H1200. An electric wiring tape H1300 is bonded and fixed to the second plate H1400 by TAB, and positioned with respect to the element substrates H1100 and H1101. The electric wiring tape H1300 supplies an electric signal to the element substrates H1100 and H1101 to discharge ink. The electric wiring tape H1300 includes electric wiring lines corresponding to the element substrates H1100 and H1101. The electric wiring tape H1300 is connected to an electric contact substrate H2200 having an external signal input terminal H1301 which receives an electric signal from the inkjet printing apparatus main body. The electric contact substrate H2200 is positioned and fixed to the ink supply unit H1003 by terminal positioning holes H1309 and H1310.

Figure 11:
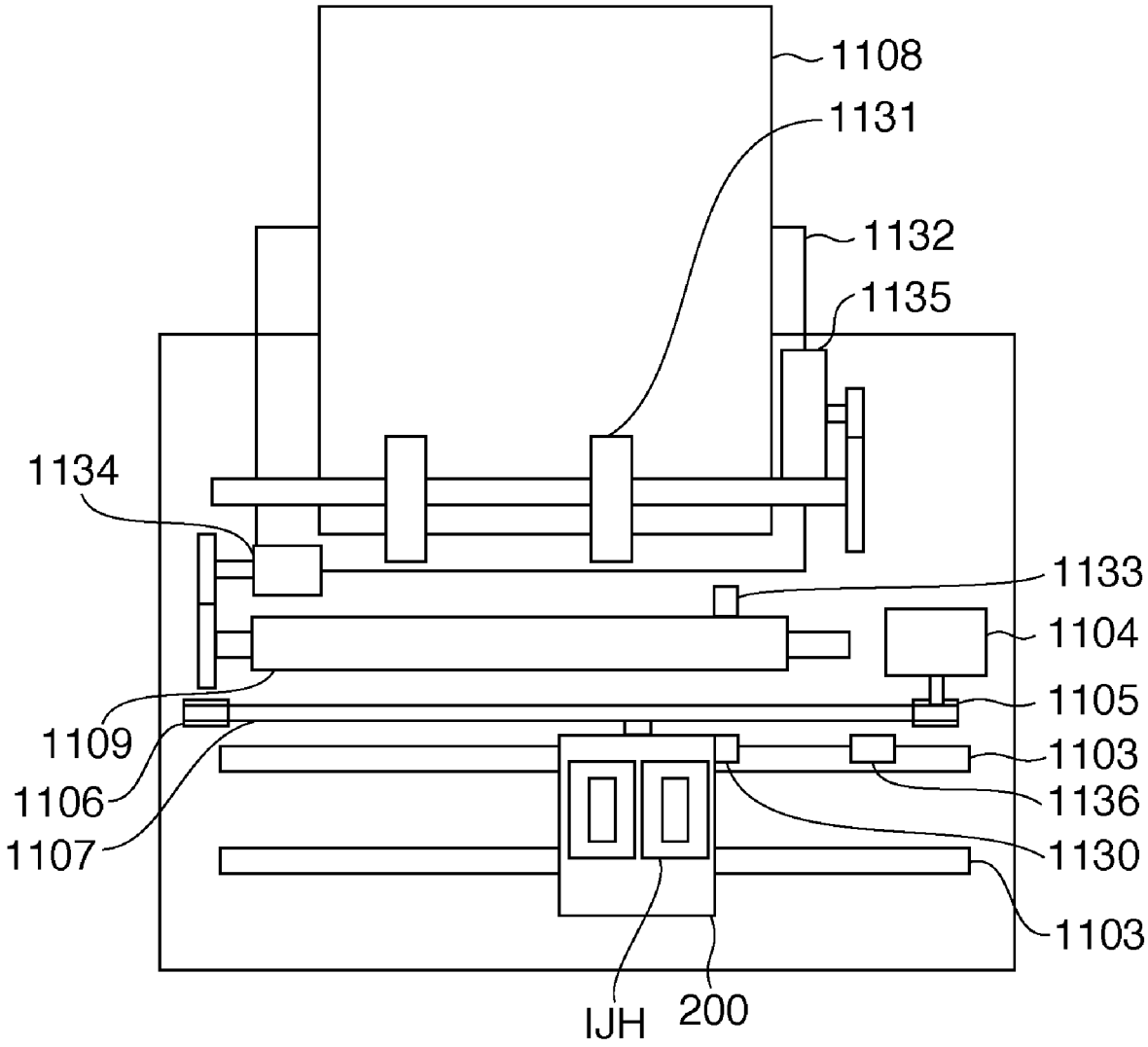
FIG. 11 is a schematic view showing an example of an inkjet printing apparatus according to the present invention.

Next, an inkjet printing apparatus (to be referred to as a printing apparatus hereinafter) capable of mounting the above-described cartridge type printhead will be explained. FIG. 11 is an explanatory view showing an example of a printing apparatus capable of mounting an inkjet printhead according to the present invention.

Referring to FIG. 11, the printing apparatus includes the head carriage 200 in which the printhead IJH shown in FIGS. 8A and 8B is positioned and exchangeably mounted. The head carriage 200 has an electrical contact for transmitting a driving signal and the like to each discharge portion via an external signal input terminal on the printhead IJH.

The head carriage 200 is supported to be able to reciprocate along a guide shaft 1103 which is arranged in the apparatus main body and elongates in the scanning direction. The head carriage 200 is driven by a scanning motor 1104 via a driving mechanism including a motor pulley 1105, associated pulley 1106, and timing belt 1107, and the position and movement of the head carriage 200 are controlled. The head carriage 200 has a home position sensor 1130. When the home position sensor 1130 on the head carriage 200 passes the position of a shielding plate 1136, it detects the home position.

Printing media 1108 such as printing sheets or plastic thin plates are separated and fed one by one from an auto sheet feeder (ASF) 1132 by rotating pickup rollers 1131 via gears by a feed motor 1135. A conveyance roller 1109 rotates to convey the printing medium 1108 via a position (printing position) where the printing medium 1108 faces the orifice surface of the printhead IJH. The driving force of an LF motor 1134 is transmitted to the conveyance roller 1109 via gears. When the printing medium 1108 passes a paper end sensor 1133, it is determined whether the printing medium 1108 has been fed, and the printing start position upon feeding is finalized. The paper end sensor 1133 is also used to determine the actual position of the tailing end of the printing medium 1108 and finally determine the current printing position from the actual trailing end.

A control arrangement for executing printing control of the above-described printing apparatus will be explained.

Figure 12:
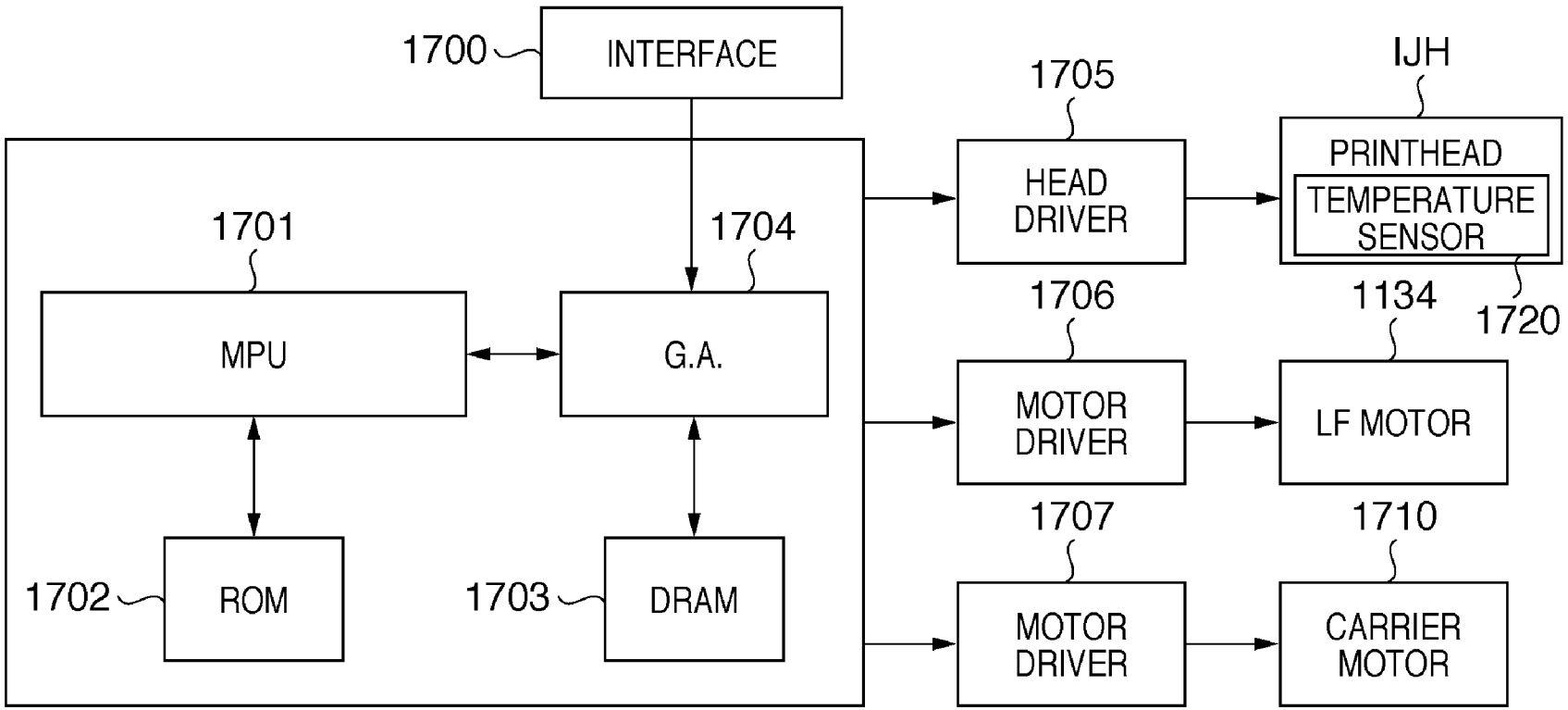
FIG. 12 is a block diagram showing the control arrangement of the inkjet printing apparatus according to the present invention.

FIG. 12 is a block diagram showing the arrangement of the control circuit of the printing apparatus.

In FIG. 12, an interface 1700 inputs a printing signal. Reference numeral 1701 denotes an MPU. A ROM 1702 stores a control program to be executed by the MPU 1701. A DRAM 1703 saves various data (e.g., a printing signal supplied to the printhead IJH). A gate array (G.A.) 1704 supplies and controls printing data to the printhead IJH. The gate array 1704 also controls data transfer between the interface 1700, the MPU 1701, and the DRAM 1703. A carrier motor 1710 conveys the printhead IJH. The LF motor 1134 conveys a printing medium. A head driver 1705 drives the printhead IJH, a motor driver 1706 drives a LF motor 1134, and a motor driver 1707 drives the carrier motor 1710. The printhead IJH comprises a temperature sensor 1720 which detects the temperature of the printhead IJH.

The operation of this control arrangement will be explained. When printing data is input to the interface 1700, it is converted into printing data between the gate array 1704 and the MPU 1701. Then, the motor drivers 1706 and 1707 are driven. At the same time, the printhead IJH is driven in accordance with the printing data sent to the head driver 1705, thereby printing.

Several embodiments of a printhead used in a printing apparatus having the above-described arrangement will be explained.

First Embodiment

Figure 1:
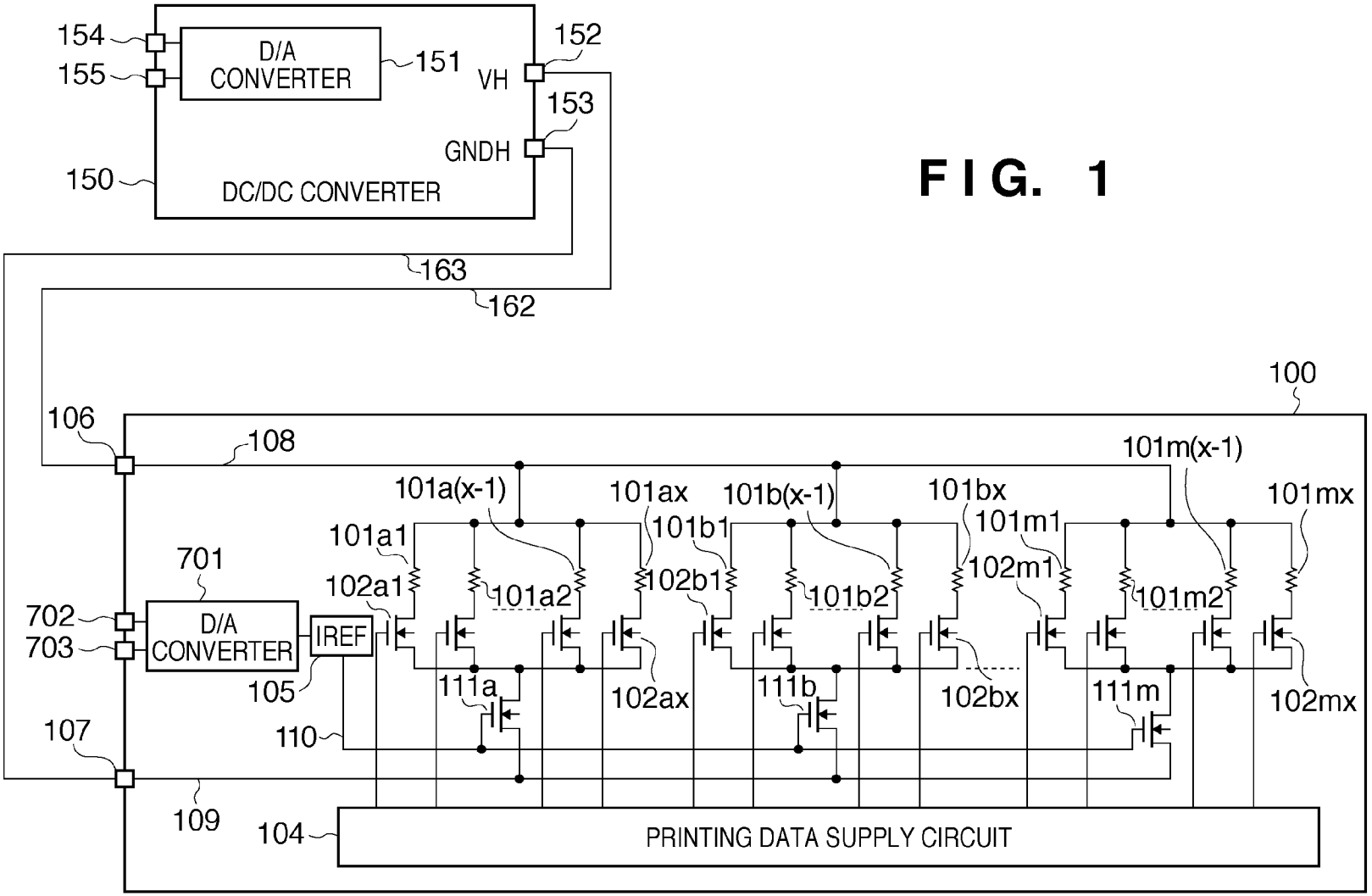
FIG. 1 is a circuit diagram of an inkjet printhead according to the first embodiment of the present invention.

FIG. 1 is a circuit diagram for explaining a main part of an inkjet printhead according to the first embodiment.

Figure 7:
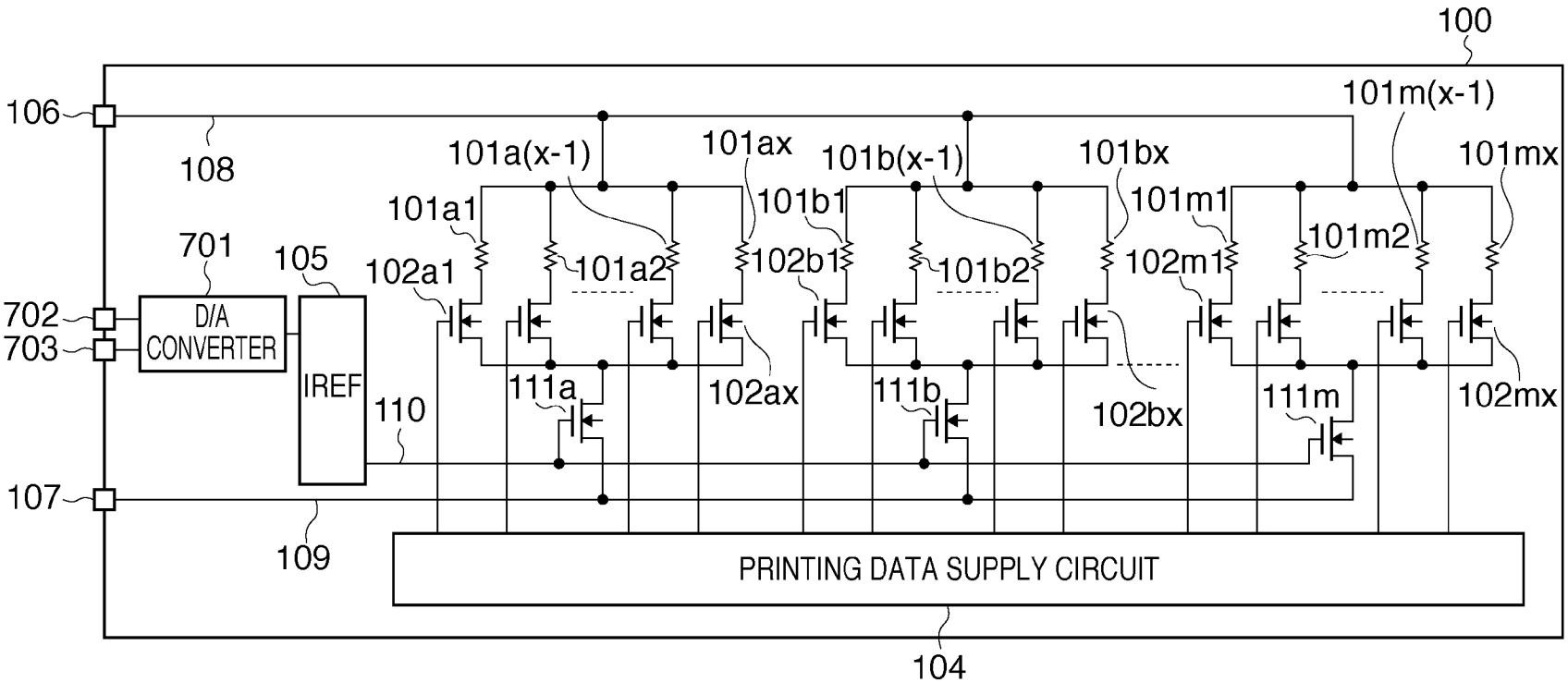
FIG. 7 is a circuit diagram of an inkjet printhead according to still another prior art of the present invention.

In FIG. 1, an element substrate 100 has the same arrangement as that of the element substrate 100 in FIG. 7, and a detailed description thereof will not be repeated. The element substrate 100 is connected via power supply terminals 106 and 107 to a DC/DC converter 150 which directly receives a DC voltage via a D/A converter 151. A power voltage VH and ground voltage GNDH are output from the DC/DC converter 150 via terminals 152 and 153. Power supply lines 162 and 163 supply the power voltage VH and ground voltage GNDH, respectively. Terminals 154 and 155 supply data to the D/A converter 151.

Figure 2A:
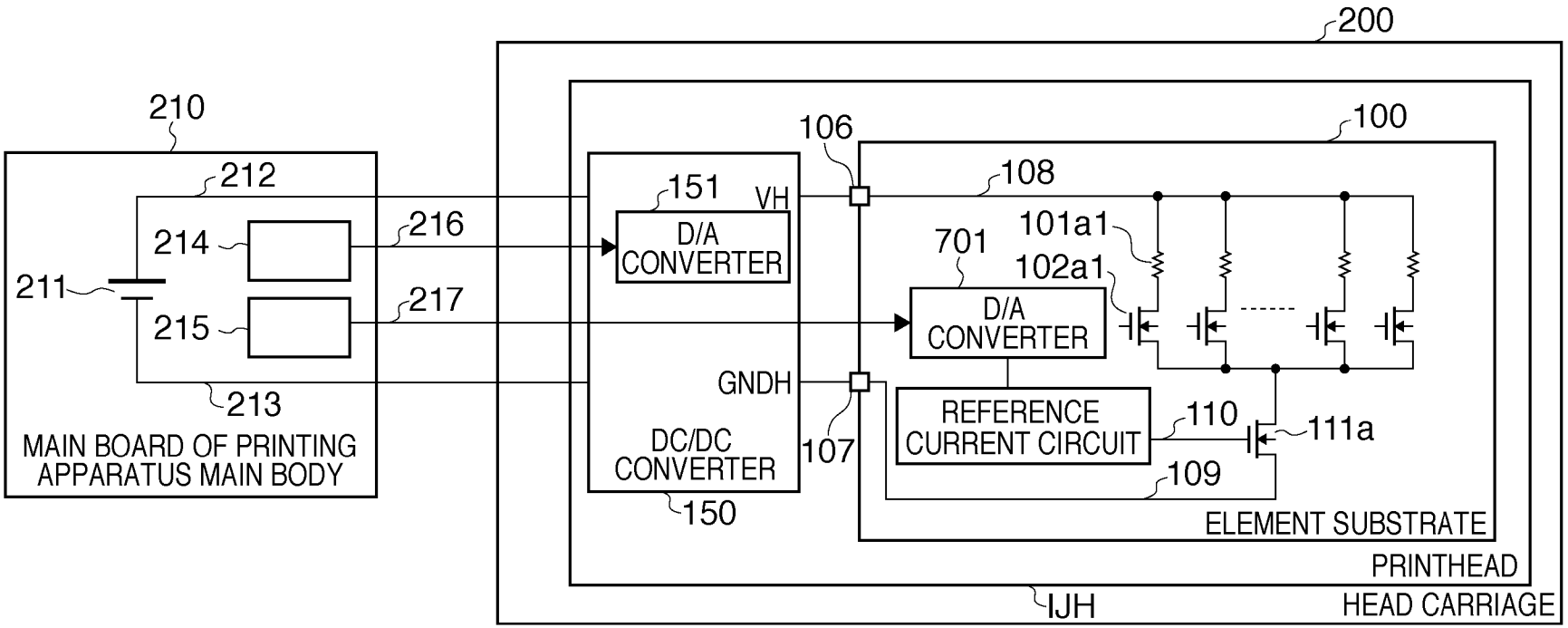
FIGS. 2A and 2B are circuit diagrams of the inkjet printhead according to the first embodiment.
Figure 2B:
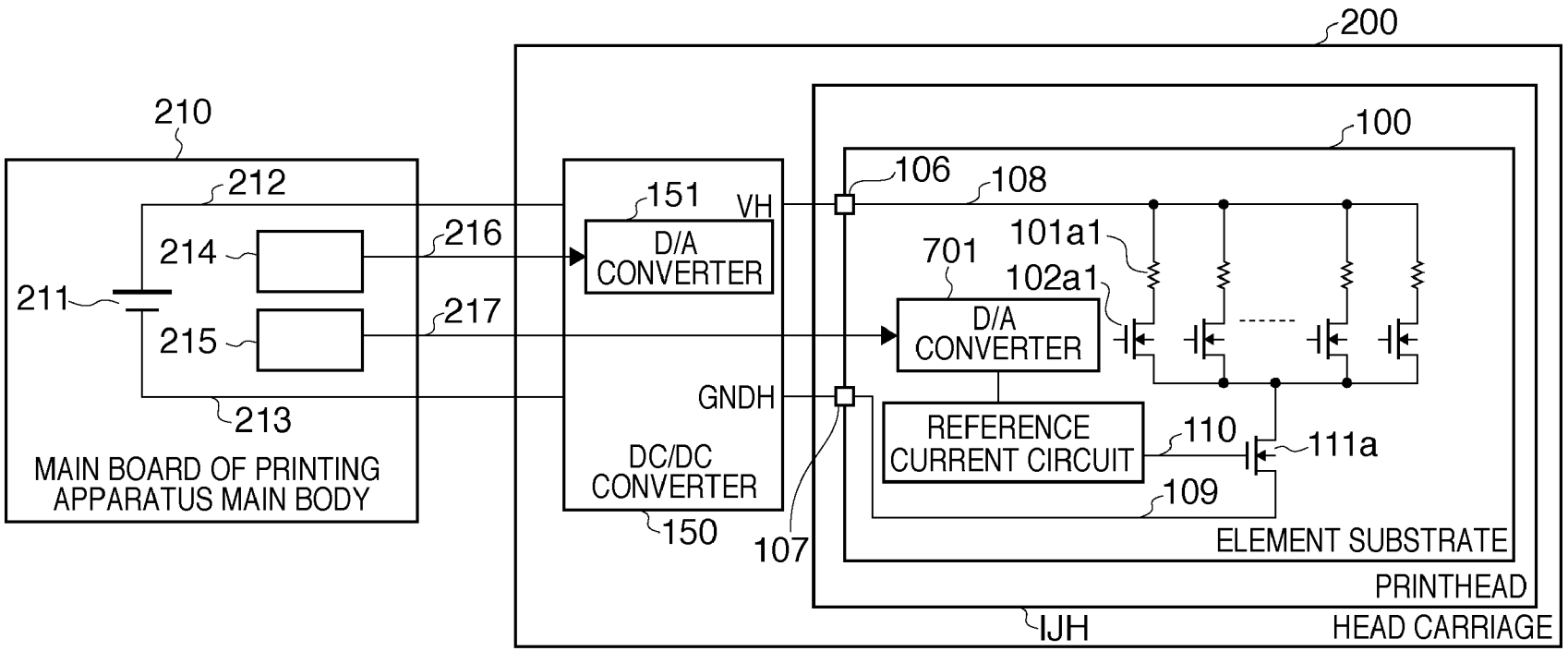

FIGS. 2A and 2B are circuit diagrams for further explaining the first embodiment.

A head carriage 200 includes the element substrate 100 and DC/DC converter 150. A main board 210 of the printing apparatus main body drives the element substrate 100 and DC/DC converter 150. The DC/DC converter 150 may also be arranged on the printhead or the head carriage separately from the printhead. FIG. 2A shows a printing apparatus in which the DC/DC converter 150 is arranged on the printhead IJH. FIG. 2B shows a printing apparatus in which the DC/DC converter 150 is arranged on the head carriage 200 separately from the printhead IJH. The arrangement in FIG. 2A will be described, but the following description also applies to that in FIG. 2B. A power supply 211 is arranged in the main body, and supplies a voltage to the DC/DC converter 150 via power supply lines 212 and 213. A data generator 214 generates data for obtaining a desired voltage value for the DC/DC converter 150, and serially outputs them to the D/A converter 151 via a line 216. A data generator 215 generates data for obtaining a desired current value to perform constant current driving by a D/A converter 701 connected to a reference current circuit 105. The data generator 215 serially outputs the data to the D/A converter 701 via a line 217. The line 216 includes two lines connected to the terminals 154 and 155. The line 217 includes two lines connected to the terminals 702 and 703.

This arrangement can parallel-set a current value for performing constant current driving, and the voltage value of the DC/DC converter 150.

Setting of a current value for performing constant current driving using the D/A converter is performed by circuits formed on a single element substrate. Thus, this makes it possible to set different current values to perform driving at high speed. For this reason, this enables variations of power consumed by heating elements depending on the number of simultaneously ON heating elements that changes in correspondence with ever-changing printing data to be suppressed. Even if the ink discharge characteristic varies upon an abrupt change of the printhead temperature, the set current value can be instantaneously adjusted so as to continue stable ink discharge.

The voltage value of the DC/DC converter is set by a switching regulator which charges/discharges a large-capacity capacitor arranged on the head carriage outside the element substrate. For this reason, a change of the voltage upon setting the voltage value of the DC/DC converter takes a time longer than the time of a change of the current of the constant current circuit. When performing constant current driving, a MOS transistor serving as a constant current source absorbs a voltage and consumes power in order to keep power consumption of the heating element constant. If heat generated by the MOS transistor is large, the temperature of the printhead itself rises. However, the DC/DC converter is not arranged on the element substrate, and changes the voltage from outside the element substrate. In this way, not only the MOS transistor arranged on the element substrate absorbs a voltage, but also the DC/DC converter changes it from outside the element substrate. With this arrangement, the temperature of the printhead according to the first embodiment hardly rises and rarely influences the discharge characteristic.

According to the present invention, not only voltage fluctuations are absorbed by driving the printhead using a constant current source, but also the voltage value is set by the DC/DC converter. The present invention maximizes these features. For example, variations of the ink discharge characteristic are suppressed by constant current driving against a factor with relatively fast temporal variation, such as voltage fluctuations depending on the ever-changing number of simultaneously ON heating elements, or voltage fluctuations upon an abrupt change of the printhead temperature. The circuit of the MOS transistor serving as a constant current source is built in as a chip in the element substrate. This circuit can absorb occurred voltage fluctuations within a short time to correct the fluctuations. Also, there is a voltage fluctuation factor with relatively slow temporal variation, such as voltage fluctuations between printheads that are derived from the difference of the resistance value of the heating element between the printheads. Against this factor, variations of the ink discharge characteristic are suppressed to correct voltage fluctuations by setting, by the DC/DC converter, the value of a voltage input from outside the element substrate. In addition, upon fluctuations of a power supply voltage applied from the main board of the main body, variations of the ink discharge characteristic are suppressed by converting the power supply voltage into a stable voltage by the DC/DC converter.

In the first embodiment, MOS transistors serving as constant current sources are arranged in respective groups of heating elements. However, the present invention is not limited to this arrangement.

Second Embodiment

Figure 3:
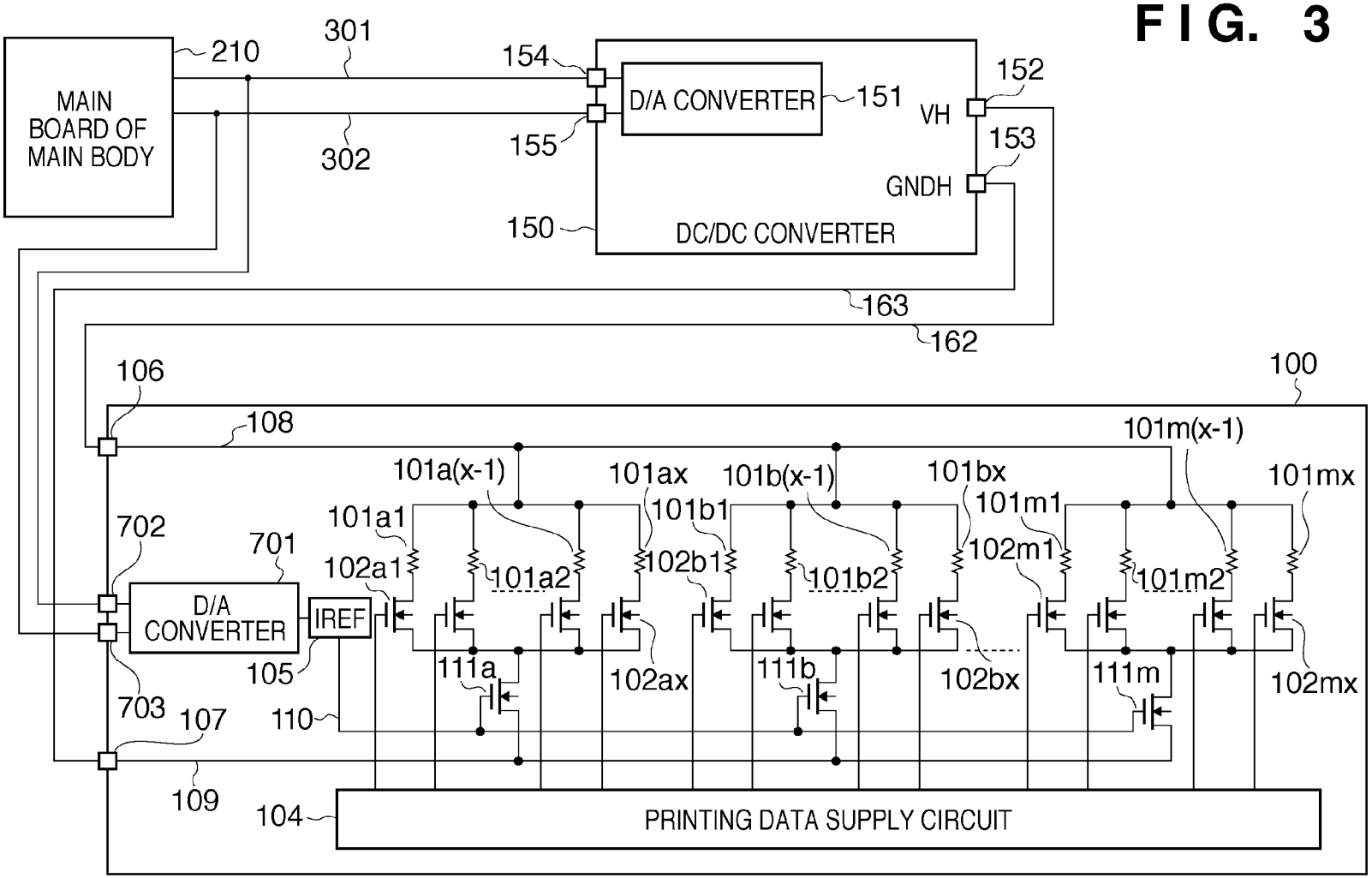
FIG. 3 is a circuit diagram of an inkjet printhead according to the second embodiment of the present invention.

FIG. 3 is a circuit diagram for explaining the main part of an inkjet printhead according to the second embodiment.

FIG. 3 shows an example in which the lines 216 and 217 for supplying data from the main board 210 to the D/A converter 151 and D/A converter 701 are shared as lines 301 and 302. The remaining arrangement is the same as that in the first embodiment.

Since lines for supplying data to a D/A converter 151 and D/A converter 701 are shared, the number of lines can be reduced from that of the printhead of the first embodiment in which lines are individually arranged.

Third Embodiment

Figure 4:
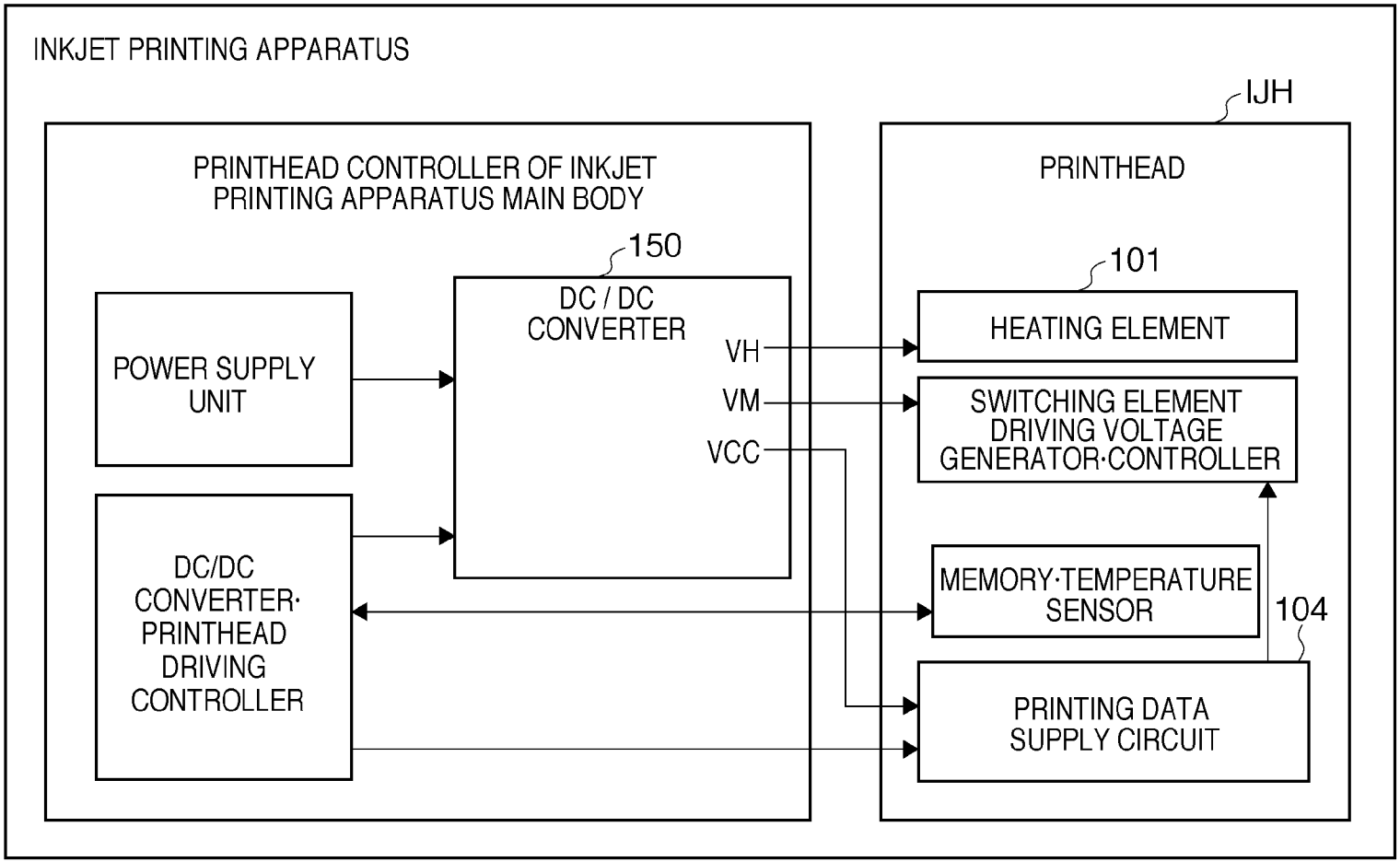
FIG. 4 is a block diagram of an inkjet printing apparatus in which a printhead is mounted according to the third embodiment of the present invention.
Figure 5:
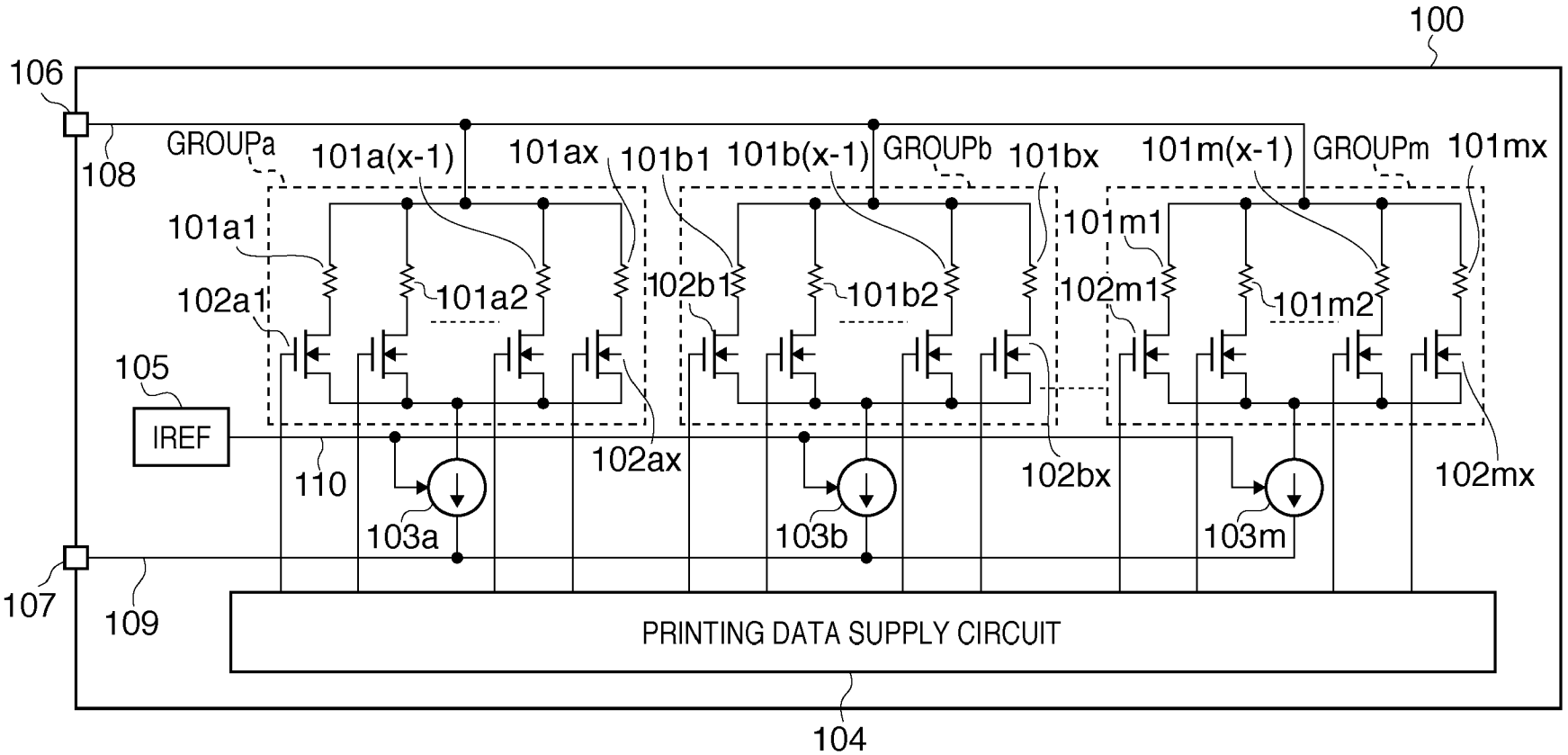
FIG. 5 is a circuit diagram of an inkjet printhead according to a prior art of the present invention.
Figure 6:
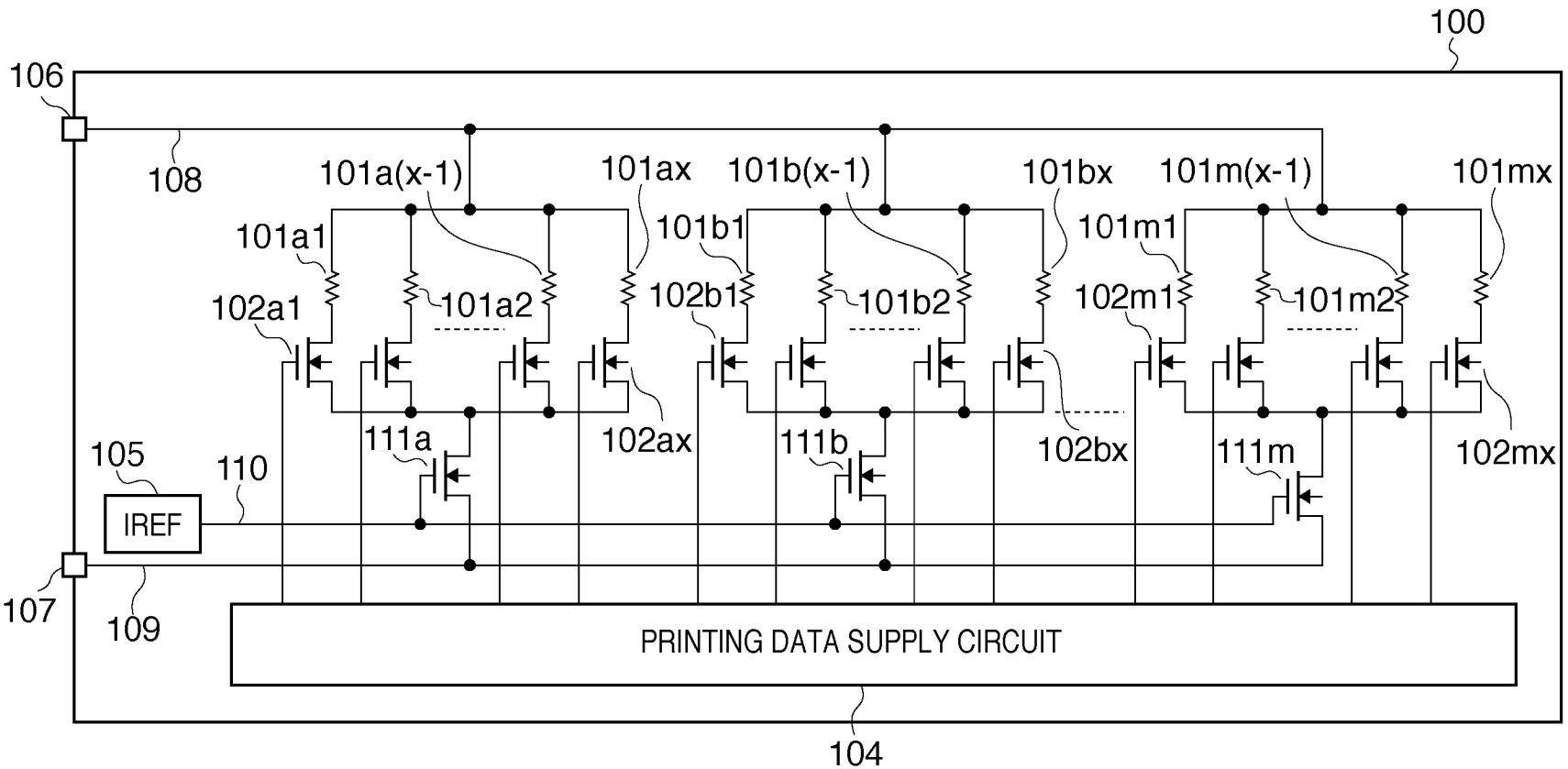
FIG. 6 is a circuit diagram of an inkjet printhead according to another prior art of the present invention.

FIG. 4 is a block diagram showing an inkjet printing apparatus in which a DC/DC converter is arranged in the inkjet printing apparatus main body.

A printhead IJH of the inkjet printing apparatus according to the third embodiment comprises a memory. The memory stores information on the driving voltage of a switching element (MOS transistor for driving a heating element). The switching element is driven at a voltage higher than the logic voltage of each logic circuit of a printing data supply circuit 104 for constant current driving, and lower than the driving voltage of the heating element. The memory also stores information on the heating element driving time. The printhead IJH comprises a temperature sensor capable of measuring the temperature of the element substrate. Driving of the printhead can be controlled based on a temperature measured by the temperature sensor.

As described above, printheads are sometimes manufactured with different resistance values of heating elements. More specifically, the resistance value is sometimes different by 20% to 30%. Due to the difference in resistance value, the switching element may suffer large power loss upon constant current driving at a predetermined current value. This is because an excessive voltage is applied to the printhead when the resistance value of the heating element is small. Even the printhead performance is influenced.

The third embodiment reduces power loss and achieves energy saving by controlling a driving voltage VH applied from a DC/DC converter 150 to a heating element 101. The DC/DC converter 150 converts a DC voltage input from a power supply unit to simultaneously control even a driving voltage VM of the switching element and a driving voltage VCC of each logic circuit. Let Icst be a constant current value, n be the maximum number of simultaneously driven heating elements, and RC be the wiring resistance of a power supply line shared between the heating elements. Further, let RL be the wiring resistance of a power supply line not shared between the heating elements, and RH be the resistance value of the heating element. Also, when the number of simultaneously driven heating elements is maximum, let V be a voltage necessary to operate, in a saturation region, a MOS transistor which drives a heating element, and Va be a predetermined margin voltage. In this case, the driving voltage VH of the heating element is given by Icst×(n×RC+RH+RL)+V+Va. In this case, the voltage Va is about 1 V. The resistance value RH of the heating element can be the average of the resistance values of the heating elements.

In the third embodiment, even the printhead temperature can be monitored. In accordance with the printhead temperature, the DC/DC converter 150, DC/DC converter-printhead controller, and the like can optimize energy applied to the printhead IJH and the driving time of the heating element. The third embodiment can, therefore, provide an inkjet printing apparatus capable of printing at high speed and high quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-296032, filed Nov. 14, 2007, which is hereby incorporated by reference herein in its entirety.

What is claimed is:

1. A printing apparatus having a printhead including: a plurality of printing elements; a plurality of switching elements arranged in correspondence with the respective printing elements; a constant current source which supplies a constant current to the plurality of printing elements; and a controller controlling the constant current source to adjust a current supplied to the plurality of printing elements, the apparatus comprising:

a DC/DC converter which is arranged in a main body of the printing apparatus, converts a DC voltage input from a power supply unit into voltage values of a voltage to be applied to the plurality of printing elements, a voltage to be applied to the plurality of switching elements, and a voltage to be applied to a logic circuit of the printhead, and outputs voltages of the voltage values to the plurality of printing elements, the plurality of switching elements, and the logic circuit.

2. The apparatus according to claim 1, wherein the printhead includes a temperature sensor which detects a temperature of the printhead, wherein the controller adjusts the current supplied to the plurality of printing elements in accordance with a temperature detected by the temperature sensor, and where the DC/DC converter outputs a voltage of a voltage value based on a resistance value of each of the plurality of printing elements.

3. The apparatus according to claim 1, wherein the DC/DC converter converts the voltage output to the plurality of printing elements to satisfy $$Icst\times(n\times RC+RH+RL)+V+Va,$$

where Icst is a constant current value supplied to the plurality of printing elements, n is a maximum number of simultaneously driven heating elements, RC is a wiring resistance of a power supply line shared between the heating elements, RL is a wiring resistance of a power supply line not shared between the heating elements, RH is an average of resistance values of the heating elements, V is a voltage necessary to operate, in a saturation region, the plurality of switching elements when the number of simultaneously driven heating elements is maximum, and Va is a predetermined margin voltage.

* * * * *